US006528731B2

(12) United States Patent
Murakami et al.

(10) Patent No.: US 6,528,731 B2
(45) Date of Patent: Mar. 4, 2003

(54) FLAT SHIELD HARNESS AND METHOD FOR MANUFACTURING THE SAME

(75) Inventors: Kazuhiro Murakami, Shizuoka (JP); Kazuhiko Watanabe, Shizuoka (JP); Kimio Tsuchiya, Shizuoka (JP); Akira Baba, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/989,299

(22) Filed: Nov. 21, 2001

(65) Prior Publication Data

US 2002/0062979 A1 May 30, 2002

(30) Foreign Application Priority Data

| | | |
|---|---|---|
| Nov. 24, 2000 | (JP) | 2000-358476 |
| Nov. 24, 2000 | (JP) | 2000-358480 |
| Nov. 24, 2000 | (JP) | 2000-358482 |
| Dec. 21, 2000 | (JP) | 2000-389288 |

(51) Int. Cl.[7] ..... H01B 7/08
(52) U.S. Cl. ..... 174/117 F
(58) Field of Search ..... 174/36, 117 F, 174/117 FF, 84 R, 78

(56) References Cited

U.S. PATENT DOCUMENTS 3,678,437 A * 7/1972 Vaden ..... 174/261
5,003,126 A * 3/1991 Fujii et al. ..... 174/115
6,167,616 B1 * 1/2001 Shinchi ..... 174/92

FOREIGN PATENT DOCUMENTS

JP 1-195608 * 8/1989
JP 6-187837 * 7/1994

* cited by examiner

*Primary Examiner*—Chau N. Nguyen
(74) *Attorney, Agent, or Firm*—Armstrong, Westerman & Hattori, LLP

(57) ABSTRACT

A flat shield harness includes a flat harness including a plurality of first conductive cores arranged in parallel and an insulating cladding which clads the first conductive cores; a thin film sheet having a thin film conductive layer; and an electric wire including a second conductive core and a second cladding which clads the second core. The thin film sheet is wound around the outer periphery of the flat harness with its ends superposed in a width direction of the flat harness, the electric wire is superposed on the ends, and the conductive layer at the ends of the thin film sheet at the ends is bonded to the second core. In this configuration, the flat shield harness can surely dissipate externally the noise which is about to invade the core of an electric wire and suppress an increase in the cost in the wire harness to be assembled.

7 Claims, 8 Drawing Sheets

FLAT SHIELD HARNESS AND METHOD FOR MANUFACTURING THE SAME

BACKGROUND OF THE INVENTION

1. Field of the Invention

This invention relates to a flat shield harness having a function of shielding noise.

2. Description of the Related Art

A motor car that is a moving body includes a wire harness arranged to supply power from a power source such as a battery to electronic appliances such as various lamps and various motors mounted in the motor car, and feed a control signal to these appliances from a control device. The wire harness is composed of a plurality of electric wires. For example, a flat harness as shown in FIGS. 19 and 20 has been used as the wire harness.

As seen from FIGS. 19 and 20, a flat harness 101 is composed of a plurality of electric wires 102 in parallel to one another, a single drain wire 103, a metallic film 104 and a sheath 105. The electric wires 102 each consists of a conductive core 110 and a cladding 111 that clads the core 110. The core 110 is formed in a round shape in section, and made of copper or copper alloy. The cladding 111 is made of insulating synthetic resin. The plurality of electric wires 102 are arranged in parallel. Therefore, the cores 110 are also arranged in parallel.

The drain wire 103 is arranged in parallel to the plurality of electric wires. The drain wire 103 is formed in a round shape in section and made of conductive metal such as copper or copper alloy. The metallic film 104 is made of conductive metal such as copper or copper alloy, and formed as a thin film. The metallic film 104 covers the claddings 111 of all the electric wires 102 and is kept in contact with the drain wire 103.

The sheath 105 is made of insulting synthetic resin and sheathes the electric wires 102, drain wire 103 and metallic film 104. The flat harness 101 is formed in a belt in a state where the electric wires 102 and drain wire 103 are sheathed by the sheath 105.

In the flat harness 101, when external noise is about to invade the core 110 of each electric wire 102, it conducts to metallic film 104. The noise is dissipated outside the flat harness 101 through the drain wire 103. Thus, the metallic film 104 of the flat harness 101 can prevent the external noise from invading the core 110 of each electric wire 102.

Where the wire harness is assembled using the flat harness 101 as described above, each electric wire 102 is a "cladded electric wire" in which the electric wire is composed of the core 110 and the cladding 111, and the drain wire 103 is a "bare electric wire" which consists of only the core. Therefore, when the cladding 111 of the electric wire 102 is removed after the sheath 105 has been removed, the processing for the drain wire 103 is not required. Thus, when the cladding 111 of each electric wire 102 is removed, the drain wire 103 may be curved so that it does not become parallel to the core 110 of each electric wire 102 as seen from FIG. 19.

The cores 110 of the electric wires 102, which are parallel to each other, can be subjected to the processing in which they are equipped with a terminal metallic fitting as a single unit using a known crimping, caulking or inserting device and inserted into a connector housing. However, where the drain wire 103 is not parallel to the core 110 of each electric wire 102, it is difficult to connect the drain wire 103 to the terminal metal fitting using the above device.

Therefore, traditionally, the drain wire 103 was manually connected to the metal fitting by an operator, and each metal fitting was inserted individually into a connector housing. In this way, the conventional flat harness 101 increases a required number of man-hours in assembling the wire harness, which results in an increase in the production cost.

Further, in the above conventional technique, in order to dissipate the noise being about to invade the cores 110 of the electric wires, the drain wire 103 is connected to the thin metallic film 104 so that the contact therebetween becomes unstable in most cases. This makes it difficult to dissipate the noise trying to invade the core 110 of each electric wire 102 outside the flat harness 100.

SUMMARY OF THE INVENTION

A first object of this invention is to provide a flat shield harness which can surely dissipate externally the noise which is about to invade the core of an electric wire and suppress an increase in the cost in the wire harness to be assembled.

A second object of this invention is to provide a method for manufacturing such a flat shield harness.

In order to attain the first object, in accordance with the first aspect of this invention, there is provided a flat shield harness comprising:

- a flat harness including a plurality of first conductive cores arranged in parallel and an insulating cladding which clads the first conductive cores;
- a thin film sheet having a thin film conductive layer; and
- an electric wire including a second conductive core and a second cladding which clads the second core,
- wherein the thin film sheet is wound around the outer periphery of the flat harness with its ends superposed in a width direction of the flat harness, the electric wire is superposed on the ends, and the conductive layer at the ends of the thin film sheet at the ends is bonded to the second core.

In the above configuration, the thin film sheet is wound around the outer periphery of the flat harness with its ends superposed in a width direction of the flat harness, the electric wire is superposed on the ends, and the conductive layer at the ends of the thin film sheet at the ends is bonded to the second core. Therefore, the electric wire can be used as a drain wire.

Since the second core is bonded to the conductive layer of the thin film sheet, an electric connection can be made surely therebetween. Further, since the electric wire is superposed on the ends superposed on each other, the position where the ends are to be formed can be optionally selected.

In the above configuration, preferably, the thin film sheet has a thin insulating layer laminated to the thin conductive layer, and the insulating layer of the thin film sheet at the ends and the second cladding of the electric wire are welded to each other. This improves the mechanical strength of the bonding portion between the conductive layer and the second core.

In the configuration, the flat shield harness, further comprises a metallic plate interposed between and fixed to the ends of the thin film sheet, and the second core is bonded to the conductive layer and the metallic plate. This improves the mechanical strength of the bonding portion between the conductive layer and the second core.

In accordance with the second aspect of this invention, preferably, the thin film sheet is divided into a plurality of sub-sheets, ends of the sub-sheets are superposed on each other in a width direction of the flat harness, and the electric wire is superposed on one of the ends of the sub-sheets. In this configuration also, since the second core is bonded to the conductive layer of the sub-sheet, an electric connection can be made surely therebetween. Further, since the electric wire is superposed on the ends superposed on each other, the position where the ends are to be formed can be optionally selected.

In accordance with the first aspect to attain the second object, there is provided a method for manufacturing a flat shield harness comprising the steps of:

winding the thin film sheet around the outer periphery of the flat harness so that the conductive layer is located inside and the insulating layer is located outside and ends of the thin film sheet are superposed on each other;

superposing the electric wire on the ends of the conductor thin film; and bonding the second core of the electric wire to the conductive layer of the thin film sheet by ultrasonic welding.

In this method, because the ultrasonic welding is performed, it is not necessary to remove a part of the second core of the electric core when the electric wire is attached to the thin film sheet.

Further, since the conductive layer and second core are bonded to each other by the ultrasonic welding, it is not necessary to use any other component which is separate from the thin film sheet and the flat harness. This suppresses an increase of the number of components constituting the flat shield harness. Further, during the ultrasonic welding, the insulating layer and the second cladding are molten so that they can be welded to each other.

In accordance with the first aspect to attain the second object, there is provided a method for manufacturing a flat harness comprising the steps of:

winding the thin film sheet around the outer periphery of the flat harness so that the conductive layer is located inside and the insulating layer is located outside and ends of the thin film sheet are superposed on each other;

superposing the electric wire on the ends of the conductor thin film with a metallic plate being interposed between the ends; and bonding the second core of the electric wire to the conductive layer of the thin film sheet and the metallic plate by ultrasonic welding.

In this method, because the ultrasonic welding is performed, it is not necessary to remove a part of the second core of the electric core when the electric wire is attached to the thin film sheet.

Further, during the ultrasonic welding, the insulating layer and the second cladding are molten so that they can be welded to each other. Additionally, since the metallic plate is bonded to the second core and the conductive layer, the mechanical strength of the bonding portion between the second core and the conductive layer can be improved.

In accordance with the third aspect to attain the first object of this invention, there is provided a flat shield harness comprising:

a flat harness including a plurality of conductive cores arranged in parallel and an insulating cladding which clads the conductive cores;

a thin film sheet having a thin film conductive layer; and wherein the thin film sheet is wound around the outer periphery of the flat harness, and the thin conductive layer of the thin film sheet is bonded to a selected core of the cores of the flat harness.

In accordance with this configuration, the single core can be used as a drain wire. Since the single core is bonded to the conductive layer of the thin film sheet, an electric connection can be made surely therebetween.

In the above configuration, preferably, the thin film sheet has an insulating layer laminated on the conductive layer, and with the conductive layer located inside and the insulating layer located outside, the thin film sheet is wound around the outer periphery of the flat harness. Because of such a structure, it is possible to prevent the thin film sheet and hence the single core serving as a drain wire from being short-circuited to the other electric wire and an electronic appliance outside the flat shield harness.

In accordance with the second aspect to attain the second object, there is provided a method for manufacturing a flat shield harness comprising the steps of:

winding the thin film sheet around the outer periphery of the flat harness so that the conductive layer is located inside and the insulating layer is located outside; and bonding the conductive layer to the selected core by ultrasonic welding.

In this method, because the ultrasonic welding is performed, it is not necessary to remove a part of the second core of the electric core when the electric wire is attached to the thin film sheet.

Further, since the conductive layer and second core are bonded to each other by the ultrasonic welding, it is not necessary to use any other component which is separate from the thin film sheet and the flat harness. This suppresses an increase of the number of components constituting the flat shield harness. Further, during the ultrasonic welding, the conductive layer and the single core are bonded to each other, they can be surely metallic-bonded, thereby assuring the electric connection therebetween.

In accordance with the fourth aspect to attain the first object, there is provided a flat shield harness comprising:

a flat harness including a plurality of conductive cores arranged in parallel and an insulating cladding which clads the conductive cores;

a thin film sheet having a thin film conductive layer; and a conductive metallic piece, wherein the thin film sheet is wound around the outer periphery of the flat harness, the metallic piece is superposed on the outside of the conductive thin film sheet, and the metallic piece is bonded to the thin conductive layer of the thin film sheet and a selected core of the cores of the flat harness.

In accordance with this configuration, the single core can be used as a drain wire. Since the single core is bonded to the conductive layer of the thin film sheet, an electric connection can be made surely therebetween.

Additionally, since the metallic piece superposed on the outside of the conductive thin film sheet is bonded to the thin conductive layer of the thin film sheet and a selected core of the cores, the mechanical strength of the bonding portion between the conductive layer and the single core can be improved.

In the above configuration, preferably, the thin film sheet has an insulating layer laminated on the conductive layer, and with the conductive layer located inside and the insulating layer located outside, the thin film sheet is would around the outer periphery of the flat harness.

Because of such a structure, it is possible to prevent the thin film sheet and hence the single core serving as a drain wire from being short-circuited to the other electric wire and an electronic appliance outside the flat shield harness.

In accordance with the third aspect to attain the second object, there is provided a method for manufacturing a flat shield harness, comprising the steps of:

winding the thin film sheet around the outer periphery of the flat harness so that the conductive layer is located inside and the insulating layer is located outside;

superposing the insulating layer of the thin film sheet on the metallic piece so that the selected core of the flat harness is located on the conductive layer of the thin film sheet; and bonding the conductive layer to the metallic piece and the selected core by ultrasonic welding.

In this method, because the ultrasonic welding is performed, it is not necessary to remove a part of the second core of the electric core when the electric wire is attached to the thin film sheet.

Further, since the conductive layer and second core are bonded to each other by the ultrasonic welding, it is not necessary to use any other component which is separate from the thin film sheet and the flat harness. This suppresses an increase of the number of components constituting the flat shield harness.

Further, during the ultrasonic welding, the conductive layer and the single core are bonded to each other, they can be surely metallic-bonded. Further, since the single core is bonded to both the conductive layer and the metallic piece, the mechanical strength of the bonding portion between the conductive layer and the single core can be improved, thereby assuring the electric connection therebetween.

In the above method, preferably, the ultrasonic welding is performed using a chip in a shape of a band-plate and an anvil having a flat plane, and with the metallic piece superposed on the flat plane and flat harness in contact with the chip, the conductive layer is bonded to the metallic piece and the selected core by the ultrasonic welding. This prevents the metallic piece from being deformed after the ultrasonic welding has been done. For this reason, the mechanical strength of the bonding portion between the single core and conductive layer can be further improved, and an electric connection therebetween can be made more surely.

The above and other objects and features of the invention will be more apparent from the following description taken in conjunction with the accompanying drawings.

DESCRIPTION OF THE PREFERRED EMBODIMENTS

Figure 1:
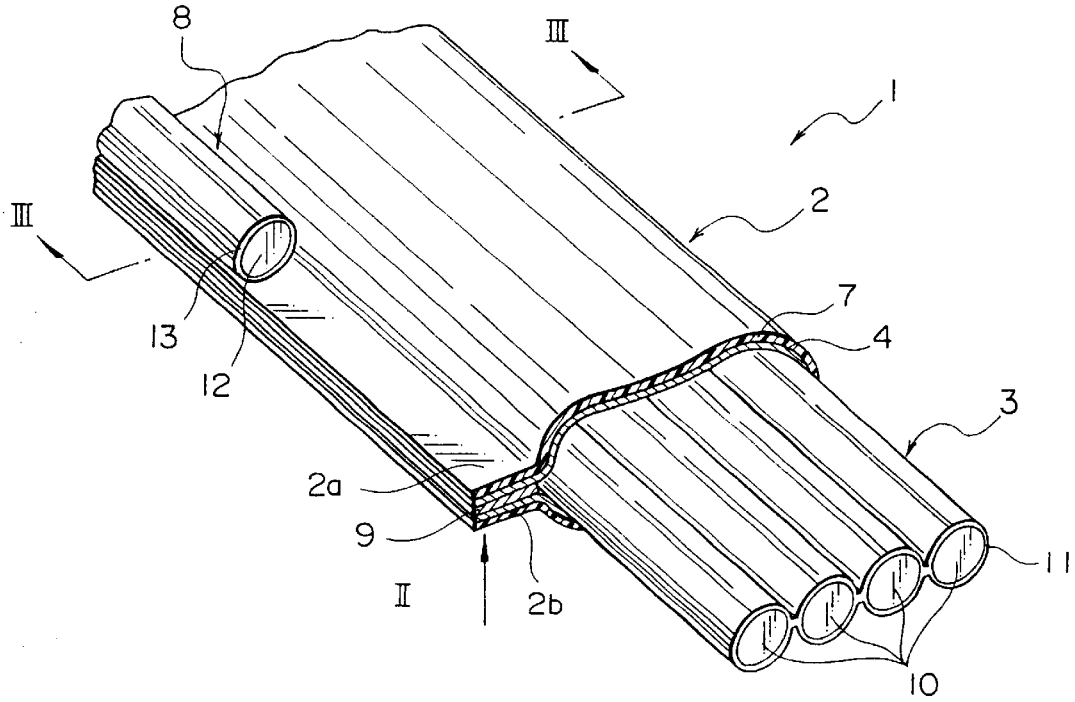
FIG. 1 is a perspective view of a flat shield harness according to the first embodiment of this invention.
Figure 2:
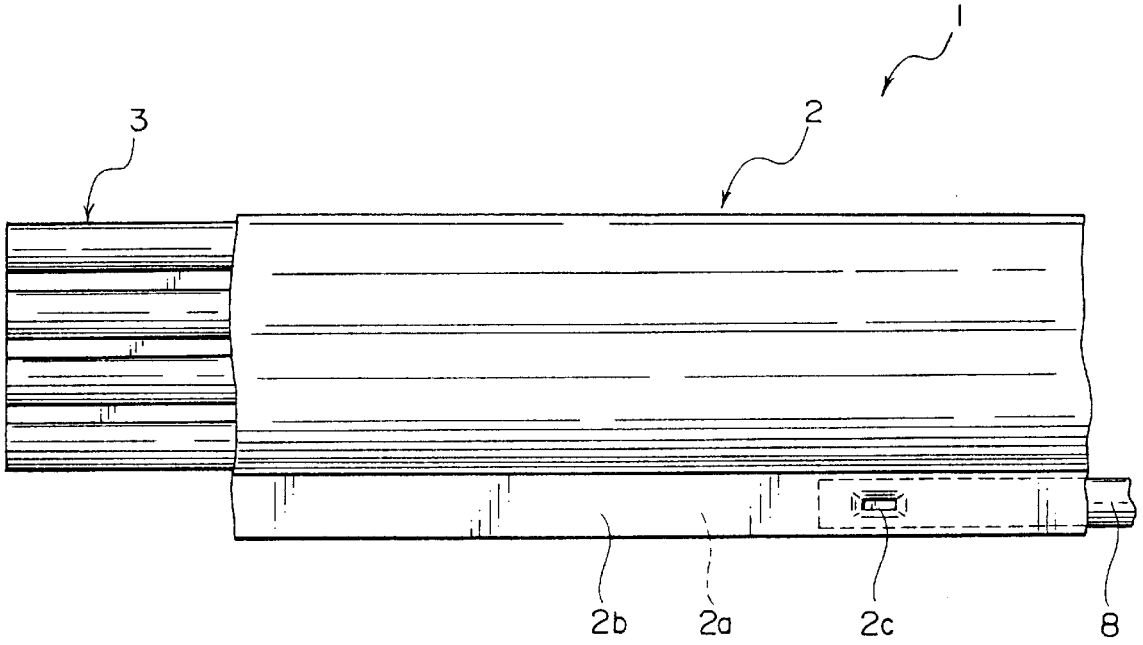
FIG. 2 is a view when the flat shield harness of FIG. 1 is viewed from the direction of an arrow II.

Now referring to the drawings, an explanation will be given of various embodiments of the flat shield harness according to this invention.

Embodiment 1

Referring to FIGS. 1 to 5, the first embodiment of the flat shield harness will be explained below. As seen from FIGS. 1 to 3, a flat shield harness, generally 1 includes a flat harness, generally 3, an aluminum laminate sheet (hereinafter referred to as ALS), generally 2 and an electric wire 8.

The flat harness 3 is a belt composed of a plurality of (first) cores 10 and a (first) cladding 11 which clads these cores 10. The core 10 includes a plurality of twisted metallic conductive wires. The core 10 is a stranded wire which is round in section. The core 10 is flexible. The core 10 contains copper or copper alloy. As seen from FIG. 3, the plurality of cores 10 are arranged in parallel to one another.

The cladding 11 is made of insulating synthetic resin. The cladding 11 clads all the cores 10 in parallel. The cladding 11 mechanically connects the cores 10 so that the flat harness 3 is formed in a belt. The cladding 11 clads the cores 10 so as to be insulated from one another.

The ALS 2 is a relatively thin sheet composed of a thin conductive layer 4, a thin insulating layer 7 laminated thereto. The conductive layer 4 is a metallic conductive layer. The conductive layer 4 is flexible. The conductive layer 4 contains copper or copper alloy. The insulating layer 7 is a double layer composed of a first insulating layer 5 and a second insulating layer 6.

The first insulating layer 5 is made of insulating synthetic resin and laminated to the conductive layer 4. The first insulating layer 5 is flexible and made of e.g. PET (polyethylene terephthalate). The second insulating layer 6 is flexible and made of e.g. PVC (polyvinylchloride).

The electric wire 8 is round in section. The electric wire 8 is composed of a second core 12 round in section and a second cladding 13 which clads the second core 12. The second core 12 includes a plurality of twisted metallic conductive wires. The second core 12 is a stranded wire which is round in section. The second core 12 is flexible. The second core 12 contains copper or copper alloy. The second cladding 13 flexible and is made of insulating synthetic resin, e.g. PVC (polyvinyl chloride).

The flat shield harness 1 is structured so that the ALS 2 with the conductive layer 4 located inside and the insulating layer 7 located outside is wound around the outer periphery of the flat harness 3. In this case, the ends 2*a* and 2*b* of the ALS 2 in the width direction of the flat harness 3 overlap each other. In this state, the ALS 2 is wound around the outer periphery of the flat harness 3.

The flat shield harness 1 also includes a metallic conductive plate 9. Its shape and size (length and width) can be optionally selected.

Figure 3:
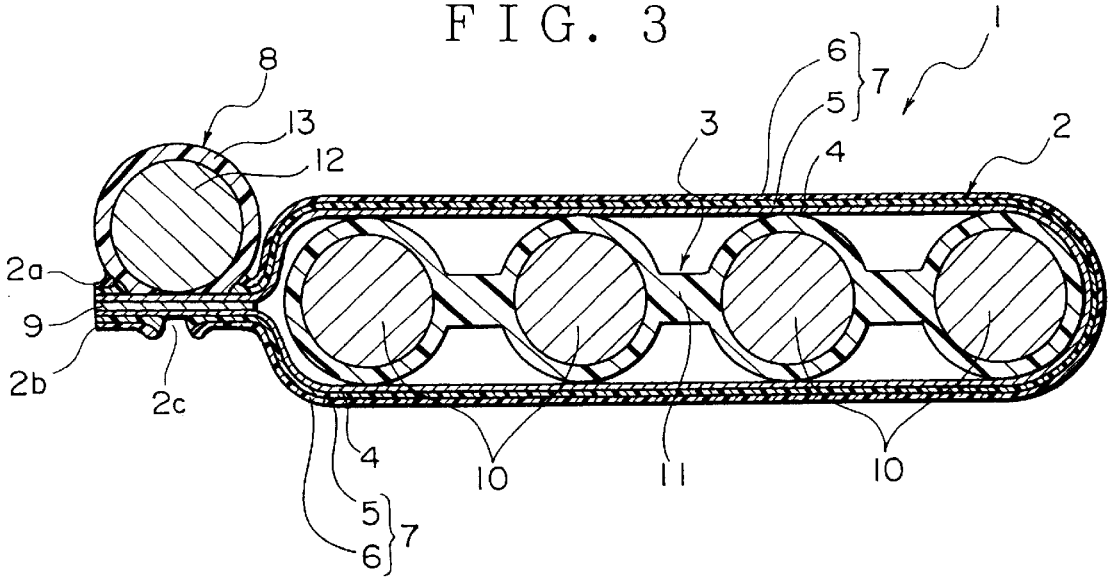
FIG. 3 is a sectional view taken along line III—III in FIG. 1.

The metallic plate 9, as seen from FIGS. 1 and 3, is interposed between the ends 2*a* and 2*b* to overlap them. The metallic plate 9 is fixed to both ends 2*a* and 2*b* via known adhesive or double-faced tape (not shown).

With the metallic plate 9 interposed between and fixed to the ends 2*a* and 2*b*, the electric wire 8 is placed on the one end 2*a* of the ends 2*a* and 2*b* on the side of the insulating layer 7. Incidentally, in FIGS. 1 and 3, the one end 2*a* on which the electric wire 8 is placed is situated at an upper o position. At a part 2*c* of the ends 2*a* and 2*b* (FIGS. 2 and 3), the conductive layer 4, metallic plate 9 and the second core 12 of the electric wire 8 are metallic-bonded.

Specifically, the second core 12 of the electric wire 8 is electrically connected to the conductive layer 4. The conductive layer 4, second core 12 and metallic plate 9 at the part 2*c* of the ends 2*a* and 2*b* of the ALS 2 can be fixed by a known technique such as spot welding or ultrasonic welding. Thus, the flat shield harness 1 is completed.

In this embodiment, the conductive layer 4, second core 12 and metallic plate 9 were fixed at the part 2*c* of the ends 2*a* and 2*b* of the ALS 2 using an ultrasonic welding machine.

Figure 4:
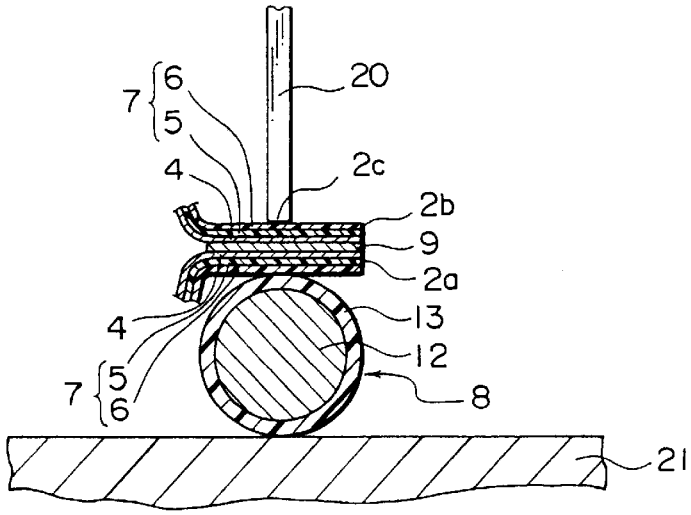
FIG. 4 is a sectional view of the state before the second core of an electric wire and the conductive layer of a conductive thin film sheet are bonded in the first embodiment.
Figure 5:
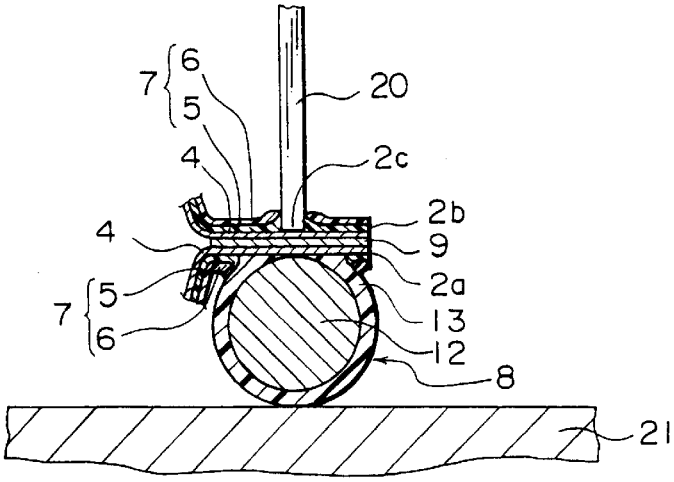
FIG. 5 is a sectional view of the state after the second core of an electric wire and the conductive layer of a conductive thin film sheet have been bonded to each other in the first embodiment.

As seen from FIGS. 4 and 5, the ultrasonic welding machine includes a chip (tool horn) 20, an anvil 21 corresponding to the chip 20, an oscillating machine (not shown), an oscillator, a cone (not shown), horn (not shown), etc. With an object to melt sandwiched between the chip 20 and anvil 21 pressurized in a direction of causing the chip 20 and anvil 21 to approach each other, the ultrasonic welding machine oscillates the oscillator by the oscillating machine and gives the oscillation to the chip 20 via the cone and horn. Thus, the ultrasonic welding machine melts the object.

In manufacturing the flat shield harness 1, the ALS 2 with the conductive layer 4 located inside and the insulating layer 7 located outside is wound around the outer periphery of the flat harness 3 so that the ends 2*a* and 2*b* overlap. The metallic plate 9 is interposed between these ends 2*a* and 2*b*. The metallic plate 9 is fixed to both ends 2*a* and 2*b* via known adhesive or double-faced tape (not shown).

The electric wire 8 is superposed on the ends 2*a* and 2*b*. Thereafter, as shown in FIG. 4, the ends 2*a* and 2*b* and the electric wire 8 are sandwiched between the chip 20 and the anvil 21. In this case, the electric wire 8 is placed on the anvil 21 and the part 2*c* of the ends 2*a* and 2*b* is brought into contact with the chip 20.

With the ends 2*a*, 2*b* and the electric wire 8 sandwiched by the chip 20 and anvil 21 pressurized in the direction of causing them to approach each other, the oscillation of the oscillator is given to the chip 20 via the corn and horn. This state is continued for a while.

Then, the conductive layer 4 at the other end 2*b* and the metallic plate 9 are metallic-bonded to each other in a solid state while they are not molten. Likewise, the conductive layer 4 at the one end 2*a* and the metallic plate 9 are also metallic-bonded while they are not molten.

The insulating layers 7 at the ends 2*a* and 2*b* are molten. Further, the above oscillation is generated between the one end 2*a* and the electric wire 8 so that the second cladding 13 of the electric wire 8 is also molten. Owing to pressurizing in the direction of causing the chip 20 and the anvil 21 to approach each other, melting of the insulating layers 7 at the ends 2*a* and 2*b* leads to removal of the insulating layer 7 from between the chip 20 and the conductive layer 4 at the other end 2*b*.

Likewise, owing to pressurizing in the direction of causing the chip 20 and the anvil 21 to approach each other, melting of the insulating layer 7 and the second cladding 13 at the one end 2*a* leads to removal of the insulating layer 7 and second cladding 13 from between the conductive layer 4 and the second core 12 at the one end 2*a*. Thus, at the one end 2*a*, the conductive layer 4 and second core 12 are brought into contact with each other. Accordingly, at the one end 2, the conductive layer 4 and the second core 12 are metallic-bonded in a solid state while they are not molten.

Specifically, as seen from FIG. 5, the respective conductive layers 4 at the ends 2*a* and 2*b*, metallic plate 9 and second core 12 are ultrasonic-welded to one another. Since the insulating layer 7 at the one end 2*a* and the second cladding 13 of the electric wire 8 have been once molten, they are welded to each other. Thus, the flat shield harness 1 can be completed in which the conductive layers 4 at the ends 2*a* and 2*b*, metallic layer 9 and the second cladding are metallic-bonded and the insulating layer 7 and the second cladding 13 are welded to each other.

The flat shield harness 1 thus completed can be used as an electric cable constituting the wire harness. The electric wire 8 bonded to the conductor 4 is connected to a desired grounding circuit. Thus, the flat shield harness 1 can dissipate the noise which is about to invade the cores 10 of the flat harness 3 to the grounding circuit, i.e. outside the flat shield harness 1 via the conductive layer 4 of the ALS 2 and the electric wire 8 bonded thereto. In other words, the ALS 2 of the flat shield harness 1 electrically shields the cores 10 of the flat harness 3.

In the flat shield harness 1 described above, the conductive layers 4 at the ends 2*a* and 2*b* and the second core 12 of the electric wire 8 are metallic-bonded. The insulating layer 7 at the one end 2*a* and the second cladding 13 of the electric wire 8 are welded to each other. In assembling the flat shield harness 1, the ALS 2 is wound around the outer periphery of the flat harness 3 so that the ends 2*a* and 2*b* overlap and the electric wire 8 is superposed on the ends 2*a* and 2*b*. In this state, the ultrasonic welding is done.

In accordance with this invention, the ultrasonic welding on the above condition bonds the second core 12 of the electric wire 8 to the conductive layers 4. Further, the electric wire 8 can be used as a drain wire. Therefore, the terminal processing for the electric wire 8 can be made in the same manner as that for an ordinary coated wire.

Thus, a metallic terminal can be attached to the electric wire 8 using a known crimping or swaging device so that it is not necessary to deal with the electric wire 8 manually. Accordingly, assembling the wire harness using the flat shield harness 1 can suppress an increase in the production cost of the wire harness.

Further, the electric wire 8 is attached to the overlapping ends 2*a* and 2*b* of the ALS 2 wound around the flat harness 3. Therefore, the position where the ends 2*a* and 2*b* are to be formed can be optionally selected and hence the location of the electric wire 8 which can be used as a drain wire can be set optionally.

Since the conductive layer 4 and second core 12 are bonded to each other during the ultrasonic welding, the insulating layer 7 and second cladding 13 are molten and removed from between the second core 12 and conductive layer 4 at the above part 2*c*. Therefore, in bonding the conductive layers 4 to the second core 12, it is not necessary to remove a part of the insulating layer 7 and the second cladding 7 at e.g. the part 2*c*. This further reduces the number of man-hours in assembling the flat shield harness 1, and further suppresses the increase in the production cost of the flat shield harness 1 and wire harness provided with it.

Further, since the conductive layer 4 and second core 12 are bonded to each other by the ultrasonic welding, it is not necessary to use any other component which is separate from the ALS 2 and the flat harness 3. This suppresses an increase of the number of components constituting the flat shield harness and hence further suppresses an increase in the production cost of the flat shield harness 1 and wire harness provided with it.

The second core 12 of the electric wire 8 and the conductive layers 4 are metallic-bonded. This assures the electrical connection between the second core 12 and the conductive layers 4. Thus, the electric wire 8 can be more surely used as a drain wire so that the noise which is about to invade the cores 10 of the flat harness 3 is dissipated externally via the electric wire 8.

The insulating layer 7 of the one end 2*a* of both ends 2*a* and 2*b* is particularly welded to the second cladding 13. The mechanical strength of the bonding portion where the conductive layer 4 and the second core 12 are bonded to each other can be improved. Thus, the conductive layer 4 and the second core 12 can be surely connected to each other so that the noise which is about to invade the cores 10 of the flat harness 3 can be surely dissipated outside through the electric wire 8.

Further, with the conductive layer 4 located inside and the insulating layer 7 located outside, the ALS 2 is wound around the outer periphery of the flat harness 3. Therefore, it is possible to prevent the ALS 2 and hence the electric wire 8 serving as a drain wire from being short-circuited to the other electric wire and an electronic appliance outside the flat shield harness 1.

Further, since the electric wire 8 is round in section, the force that causes the chip 20 and the anvil 21 to approach each other is concentrated on the position where the ends 2*a*, 2*b* of the ALS 2 are brought into contact with the electric wire 8. Therefore, the insulating layer 7 and second cladding 13 which are molten are swiftly removed from between the conductive layer 4 and the second core 12. Thus, the conductive layer 4 and second core 12 are surly bonded to each other. Accordingly, the noise which is about to invade the cores 12 of the flat harness 3 can be surely dissipated outside the flat shield harness 1.

The metallic plate 9 interposed between and fixed to the ends 2*a* and 2*b* is bonded to the conductive layers 4 at both ends 2*a* and 2*b*. Therefore, the second core 12 is also bonded to the metallic plate 9 through the conductive layer 4. This further improves the mechanical strength at the bonding portion where the conductive layer 4 and the second core 12 are bonded.

As a result, the conductive layer 4 and the second core 12 are surely connected so that the noise which is about to invade the cores 10 of the flat harness 3 can be more surely dissipated externally through the electric wire 8.

Embodiment 2

Figure 6:
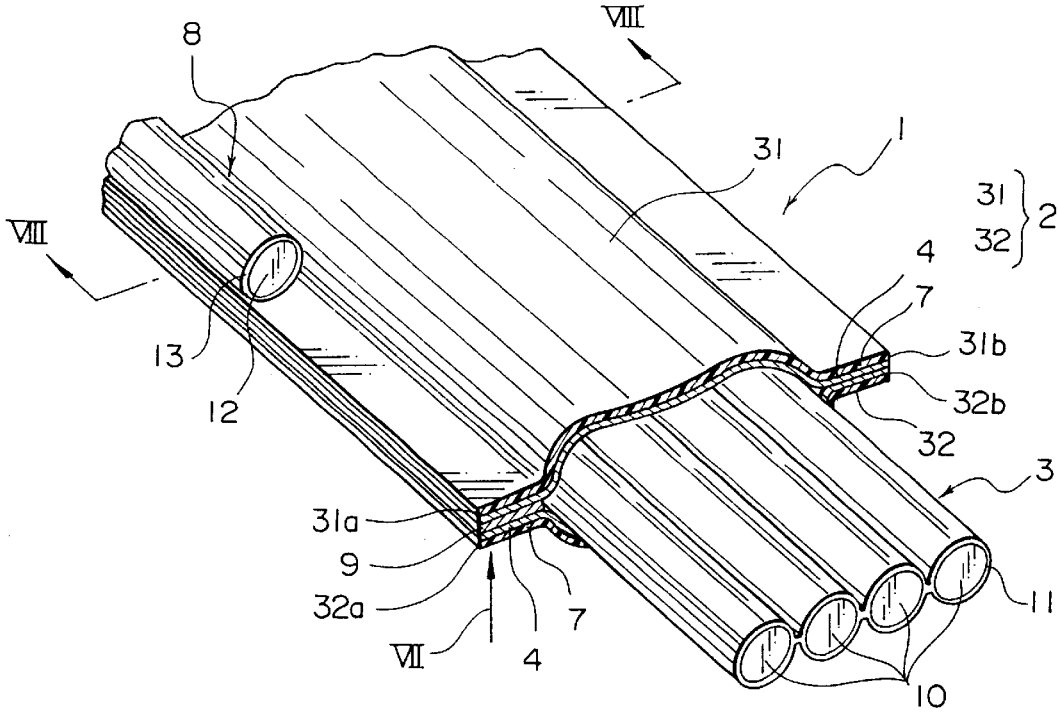
FIG. 6 is a perspective view of a flat shield harness according to the second embodiment of this invention.
Figure 7:
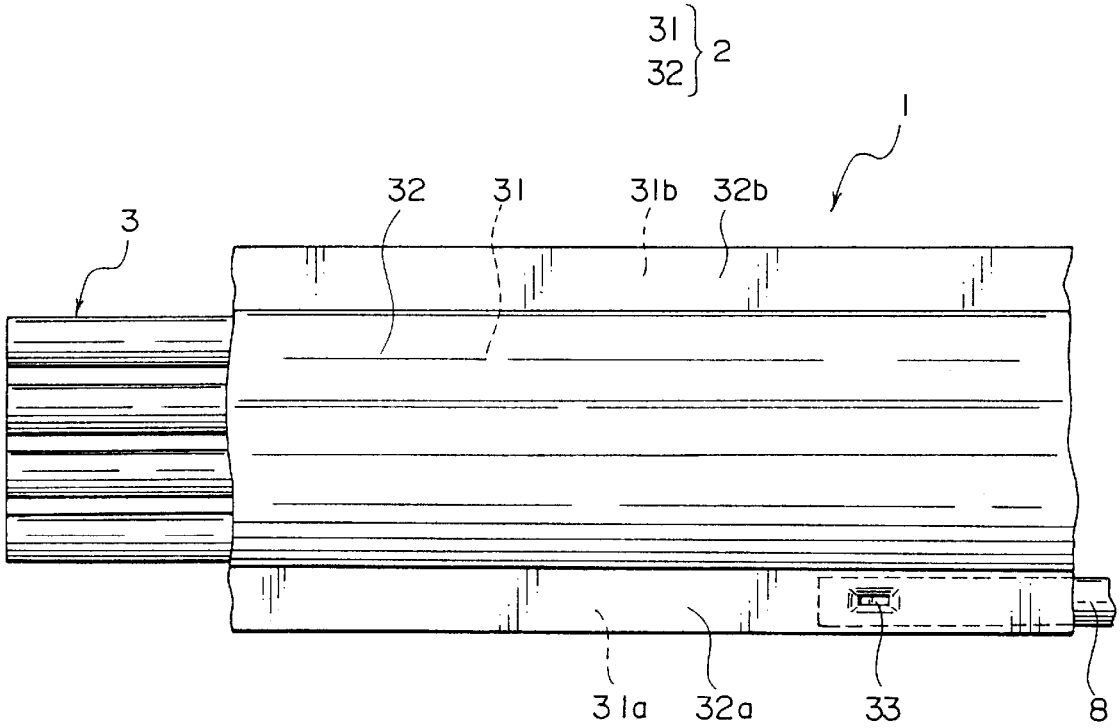
FIG. 7 is a view when the flat shield harness of FIG. 6 is viewed from the direction of an arrow VII.
Figure 8:
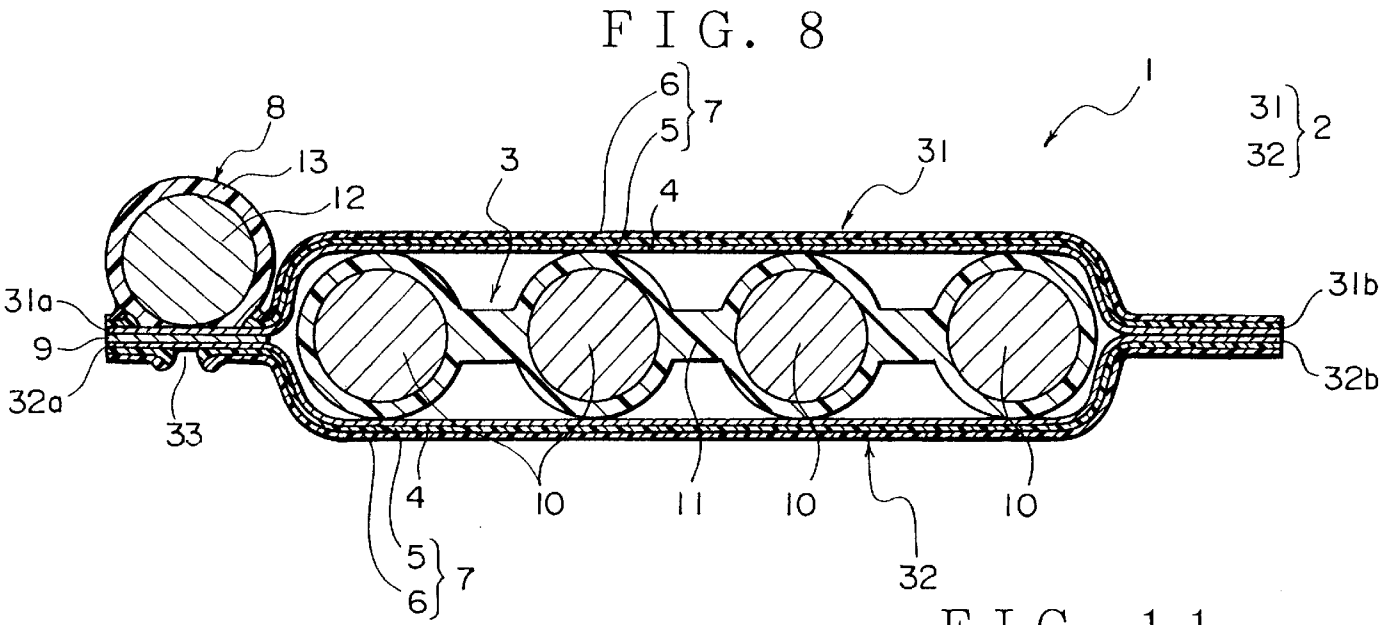
FIG. 8 is a sectional view taken along line VIII—VIII in FIG. 6.
Figure 11:
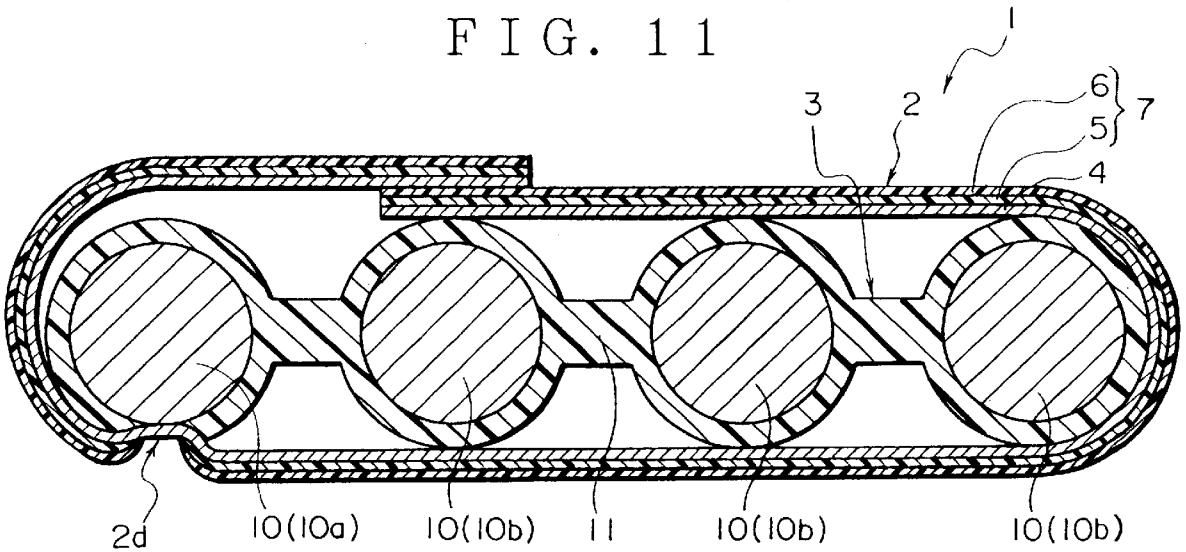
FIG. 11 is a sectional view taken along line XI—XI in FIG. 9.
Figure 9:
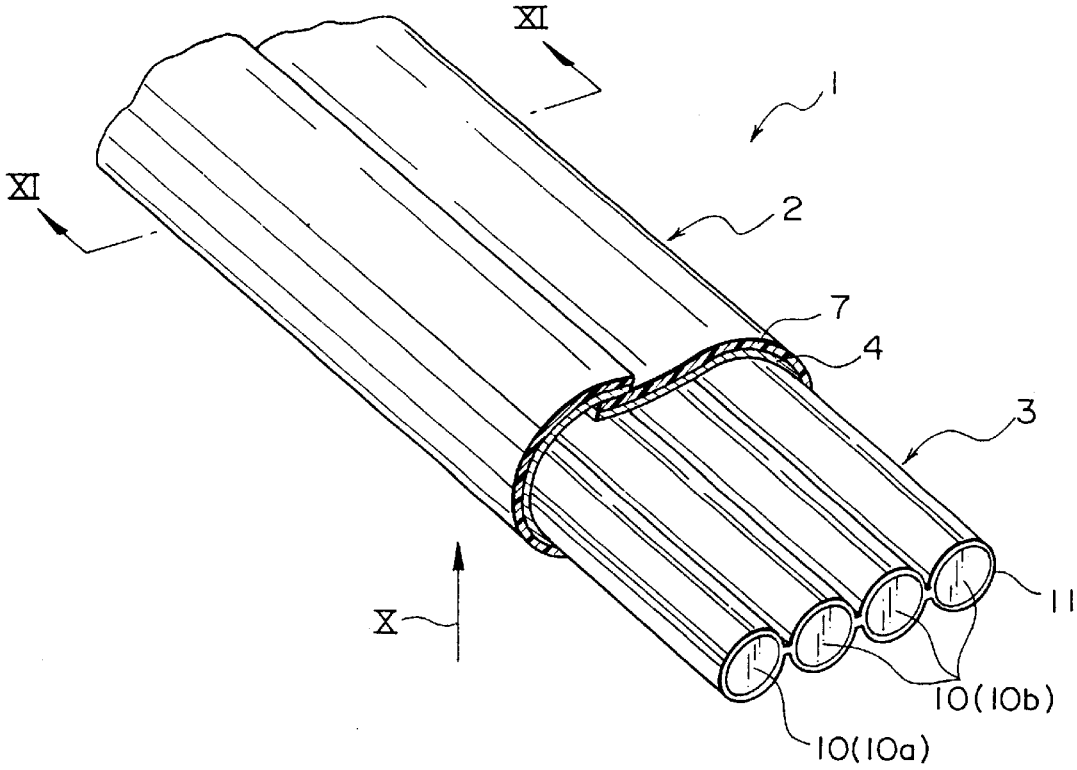
FIG. 9 is a perspective view of a flat shield harness according to the third embodiment of this invention.
Figure 14:
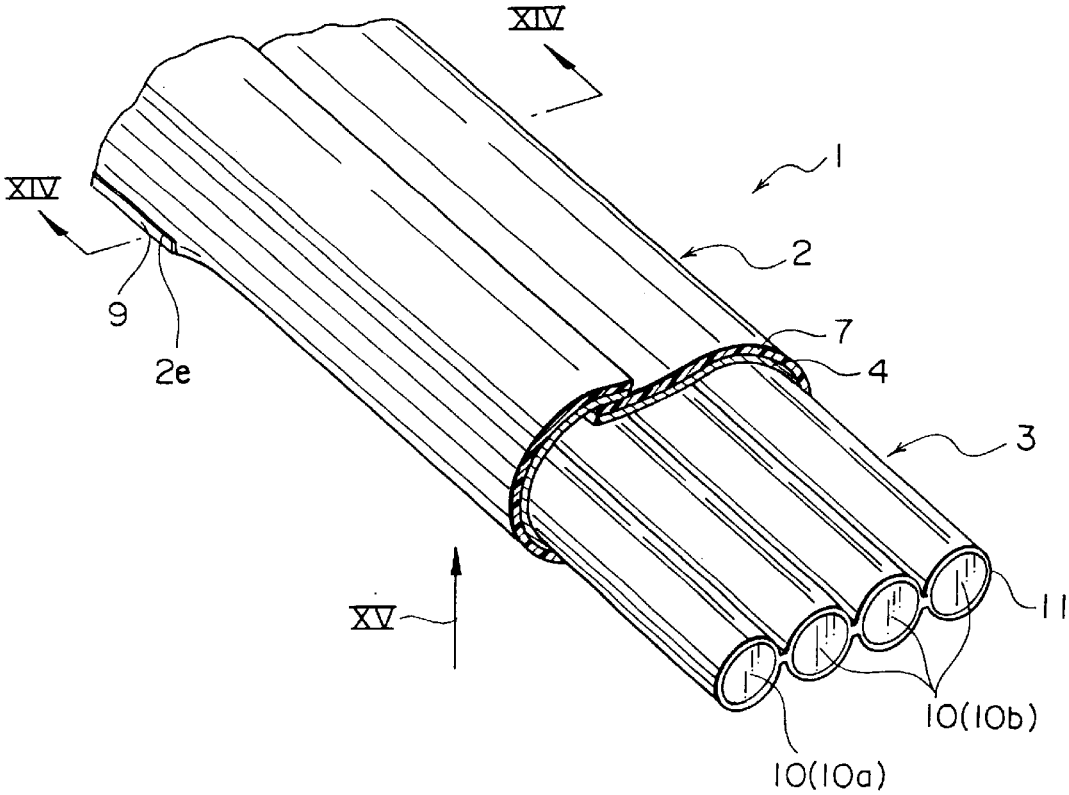
FIG. 14 is a perspective view of a flat shield harness according to the fourth embodiment of this invention.
Figure 10:
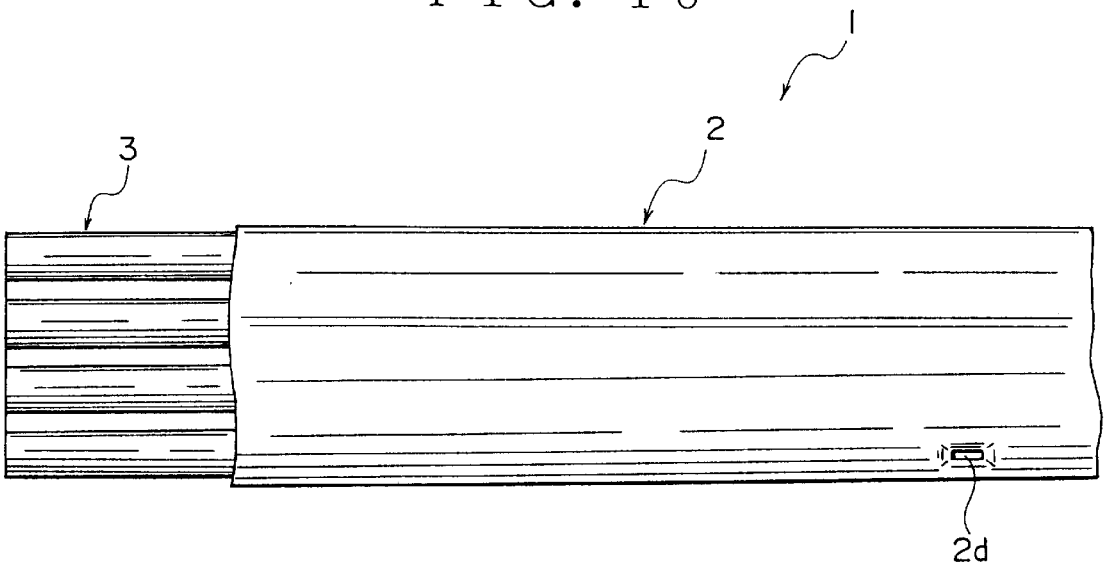
FIG. 10 is a view when the flat shield harness of FIG. 9 is viewed from the direction of an arrow X.

Referring to FIGS. 6 to 8, an explanation will be given of the second embodiment of this invention. In these figures, like reference numerals refer to like elements in the first embodiment. The feature of the flat shield harness 1 according to this embodiment resides in that the flat harness 2 serving as a thin film sheet is divided into plural components (sub-sheets).

In the illustrated example, the ALS 2 is divided into two sub-sheets of a first ALS 31 and a second ALS 32. These ALS's 31 and 32 are the same in their composition, and each of them is composed of a conductive layer 4 and an insulating layer 7.

In the flat shield harness 1 according to this embodiment, the ALS's 31 and 32 are wound around the outer periphery of the flat harness 3 in such a fashion that both ends 31*a* and 31*b* of the first ALS 31 in a width direction of the flat harness 3 and both ends 32*a* and 32*b* of the second ALS 32 in the direction of the flat harness 3 overlap each other, respectively. In this case, the conductive layer 4 is located inside and the insulating layer 7 is located outside. The electric wire 8 is placed on one of the overlapping ends 31*a*, 32*a* and the overlapping ends 31*b*, 32*b*. In the illustrated example, the electric wire 8 is placed on the ends 31*a*, 32*a* on the left side in FIGS. 6 and 8.

A metallic plate 9 is arranged between the overlapping ends 31*a* and 32*a* on which the electric wire 8 is placed. The metallic plate 9 is fixed to both ends 31*a* and 32*a* via known adhesive or double-faced tape (not shown). The ends 31*b* and 32*b* on which the electric wire is not placed are fixed to each other.

In the flat shield harness 1 according to this embodiment, by the ultrasonic welding, metallic bonds are made between the conductive layer 4 at a part of the end 31*a* and the metallic plate 9 and between the metallic layer 9 and the conductive layer 4 at the part 33 of the end 32*a*. In addition, the conductive layer 4 at the part 33 of the end 31*a* and the second core 12 are metallic-bonded to each other and the insulating layer 7 and the second cladding 13 are welded to each other.

Like the flat shield harness 1 according to the first embodiment, the flat shield harness 1 according to this embodiment is also assembled in such a manner that with the electric wire 8 and terminals 31*a*, 32*a* interposed between the chip 20 and the anvil 21 pressurized in a direction of causing them to approach each other, they are subjected to the ultrasonic welding.

In the flat shield harness 1 according to this embodiment, as in the first embodiment, since the conductor wire 8 is bonded to the conductive layers 4 of the first ALS 31 and the second ALS 32, it can be used as the drain wire. Assembling the wire harness using the flat shield harness according to the embodiment suppresses an increase in the production cost of the wire harness.

Further, since the electric wire 8 is bonded to the conductive layers 4 of the first ALS 31 and the second ALS 32, the noise which is about to invade the cores 10 of the flat harness 3 can be surely dissipated outside the shield harness 1.

Further, since the second core 12 of the electric wire 8 is bonded to the conductive layers 4 of the first conductive layer 31 and the second conductive layer 32 during the ultrasonic welding, it is not necessary to remove a part of the insulating layer 7 and the second cladding 13 before welding. This reduces the number of components and the number of man-hours in assembling the flat shield harness 1, and further suppresses the increase in the production cost of the flat shield harness 1 and wire harness provided with it.

Further, the insulating layer 7 at the part 33 and the second cladding 13 are welded to each other, the mechanical strength of the part can be improved. In addition, since the metallic plate 9 is bonded to both conductive layers 4 and the second core 12 is further bonded to one of the conductive layers 4, the mechanical strength of the part 33 can be further improved. Thus, the conductive layer 4 and electric wire 8 can be surely connected to each other so that the noise which is about to invade the cores 10 of the flat harness 3 can be surely dissipated outside through the electric wire 8.

The ends 31*a*, 32*a*, 31*b* and 32*b* to which the electric wire 8 is attached can be optionally selected. The position where these ends are to be formed can be optionally selected and hence the location of the electric wire 8 which can be used as a drain wire can be set optionally.

In this embodiment, the ALS 2 serving as the thin film sheet is divided into two sub-sheets. However, it is of course that the ALS 2 may be divided into three or more sub-sheets.

In this case also, the ends of the respective thin film sheets are stacked and secured, and the electric wire is fixed to one of them by the ultrasonic welding. If the thin film sheet is divided into three or more sub-sheets, the location of the electric wire 8 can be set more freely.

Embodiment 3

Referring to FIGS. 9 to 13, an explanation will be given of the third embodiment of this invention. In these figures, like reference numerals refer to like elements in FIGS. 1 to 8 concerning the first and the second embodiment.

The flat shield harness 1 is structured so that the ALS 2 with the conductive layer 4 located inside and the insulating layer 7 located outside is wound around the outer periphery of the flat harness 3. The conductive layer 4 at a part 2*d* of the ALS 2 (FIGS. 10 and 11) is bonded to one of the plurality of cores to make a metallic-bond. This selected core is denoted by 10*a* and the other cores are denoted by 10*b*.

Specifically, the core 10*a* is electrically connected to the conductive layer 4. The conductive layer 4 located at a part 2*d* of the ALS and the core 10*a* can be fixed by a known technique such as spot welding or ultrasonic welding. Thus, the flat shield harness 1 is completed.

In this embodiment, the conductive layer 4 located at a part 2*d* of the ALS 2 and the core 10*a* were bonded using an ultrasonic welding machine. Namely, the part 2*d* is a bonding position therebetween.

Figure 12:
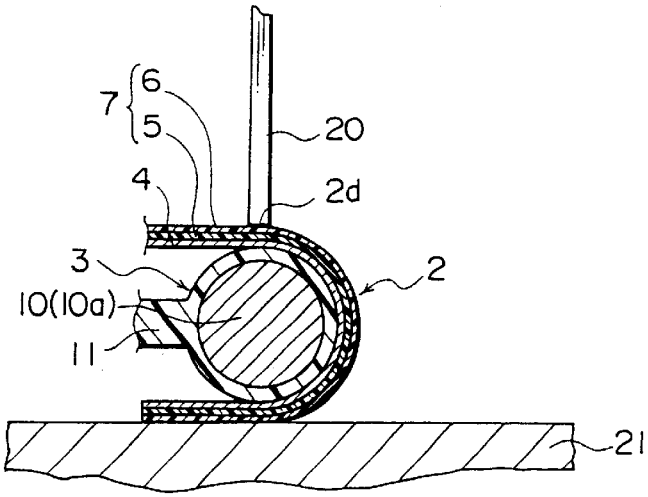
FIG. 12 is a sectional view of the state before the third core of an electric wire and the conductive layer of a conductive thin film sheet are bonded in the third embodiment.
Figure 13:
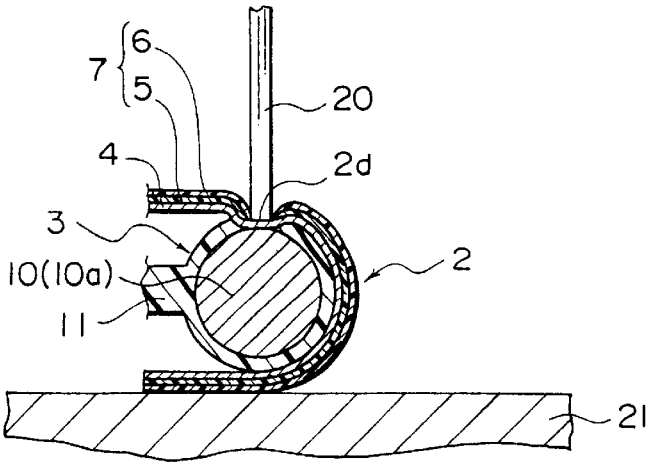
FIG. 13 is a sectional view of the state after the second core of an electric wire and the conductive layer of a conductive thin film sheet have been bonded to each other in the third embodiment.
Figure 15:
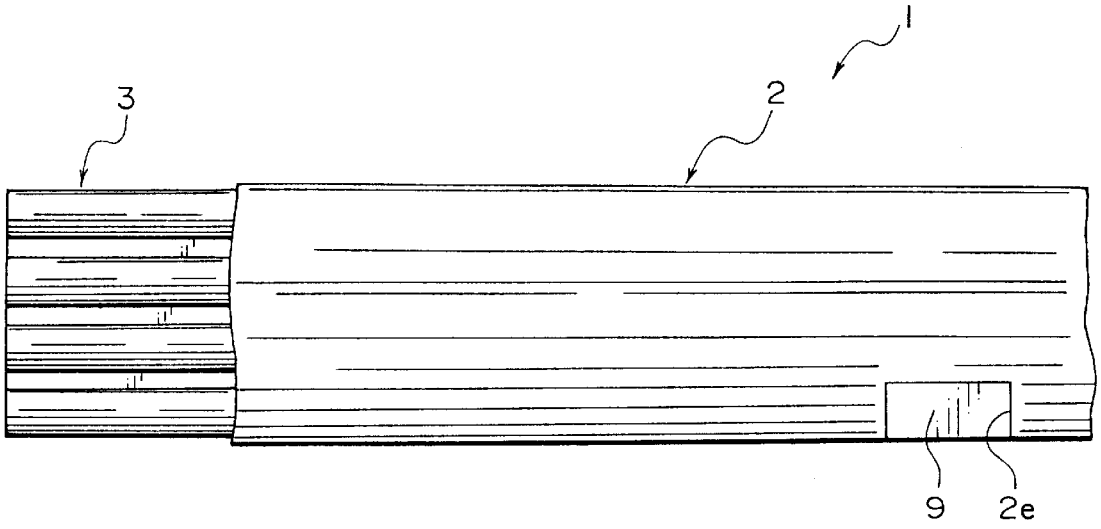
FIG. 15 is a view when the flat shield harness of FIG. 14 is viewed from the direction of an arrow XV.

As seen from FIGS. 12 and 13, the ultrasonic welding machine includes a chip (tool horn) 20, an anvil 21 corresponding to the chip 20, an oscillating machine (not shown), an oscillator, a cone (not shown), horn (not shown), etc. With an object to melt sandwiched between the chip 20 and anvil 21 pressurized in a direction of causing them to approach each other, the ultrasonic welding machine oscillates the oscillator by the oscillating machine and gives the oscillation to the chip 20 via the cone and horn. Thus, the ultrasonic welding machine melts the object.

In manufacturing the flat shield harness 1, the ALS 2 with the conductive layer 4 located inside and the insulating layer 7 located outside is wound around the outer periphery of the flat harness 3 so that the ends thereof overlap. The overlapping ends of the ALS 2 are fixed to each other via known adhesive, double-faced or single-faced tape (not shown).

Thereafter, the above part 2*d* of the ALS 2 and the core 10*a* of the flat harness 3 are sandwiched between the chip 20 and the anvil 21. In this case, the ALS 2 and flat harness 3 are placed on the anvil 21 and the part 2*d* is brought into contact with the chip 20.

With the above part 2*d* of the ALS 2 and the core 10*a* of the flat harness 3 sandwiched by the chip 20 and anvil 21 pressurized in the direction of causing them to approach each other, the oscillation of the oscillator is given to the chip 20 via the corn and horn. This state is continued for a while. Then, the oscillation is generated between the ALS 2 and flat harness 3 so that the insulating layer 7 and the cladding 11 are first molten.

Owing to pressurizing in the direction of causing the chip 20 and the anvil 21 to approach each other, melting of the insulating layer 7 and the cladding 11 leads to removal of the insulating layer 7 and cladding 11 from between the conductive layer 4 and the core 10*a*. Thus, the conductive layer 4 and core 10*a* are brought into contact with each other. Accordingly, as shown in FIG. 13, the conductive layer 4 and the core 10*a* are metallic-bonded in a solid state while they are not molten.

Namely, the conductive layer 4 and the core 10*a* are bonded to each other by the ultrasonic welding. Thus, the flat shield harness 1 can be completed in which the conductive layer 4 and the core 10*a* of the plurality of cores 10.

The flat shield harness 1 thus completed can be used as an electric cable constituting the wire harness. The core 10*a* bonded to the conductive layer 4 is connected to a desired grounding circuit. Thus, the flat shield harness 1 can dissipate the noise which is about to invade the other cores 10*b* of the flat harness 3 to the grounding circuit, i.e. outside the flat shield harness 1 via the conductive layer 4 of the ALS 2 and the electric wire 8 bonded thereto. In other words, the ALS 2 of the flat shield harness 1 electrically shields the cores 10*b* of the flat harness 3 to which the conductive layer 4 is not bonded.

In accordance with this invention, the ultrasonic welding on the above condition bonds the core 10*a* to the conductive layers 4. Further, the core 10*a* can be used as a drain wire. Therefore, the terminal processing for the core 10*a* can be made in the same manner as that for the other cores 10*b*.

Therefore, the core 10*a* used as a drain wire as well as the other cores 10*b* is connected a metallic terminal and housed in a connector housing. This does without the operation such as attaching the metal fitting for the core 10*a*, and hence reduces the number of man-hours in assembling the flat shield harness 1, thereby suppressing an increase in the production cost in the wire harness.

Since the conductive layer 4 and the core 10*a* are bonded to each other during the ultrasonic welding, the insulating layer 7 located at the part 2*d* and the cladding 11 are molten and removed from between the chip 20 and the conductive layer 4 and between the core 10*a* and conductive layer 4, respectively. Therefore, it is not necessary to remove a part of the insulating layer 7 and the cladding 11 located at e.g. the part 2*d*. This further reduces the number of man-hours in assembling the flat shield harness 1, and hence suppresses the increase in the production cost of the flat shield harness 1 and wire harness provided with it.

Further, since the conductive layer 4 and core 10*a* are bonded to each other by the ultrasonic welding, it is not necessary to use any other component which is separate from the ALS 2 and the flat harness 3. This suppresses an increase of the number of components constituting the flat shield harness 1 and hence further suppresses an increase in the production cost of the flat shield harness 1 and wire harness provided with it.

The single core 10*a* of the flat harness 3 and the conductive layer 4 are metallic-bonded. This assures the electrical connection between the single core 10*a* and the conductive layer 4. Thus, the single core 10*a* can be more surely used as a drain wire so that the noise which is about to invade the other cores 10*b* of the flat harness 3 is dissipated externally via the single core 8.

Further, with the conductive layer 4 located inside and the insulating layer 7 located outside, the ALS 2 is wound around the outer periphery of the flat harness 3. Therefore, it is possible to prevent the ALS 2 and hence the core 10*a* serving as a drain wire from being short-circuited to the other electric wire and an electronic appliance outside the flat shield harness 1.

After the conductor 4 located at the part 2*d* and the core 10*a* have been bonded, the ALS 2 can be wound around the outer periphery of the flat harness 3. Thus, the bonding part 2*d* is not exposed to the outside. In this case, it is possible to prevent the bonding between the conductive layer 4 and cores 10 from coming off so that the noise can be dissipated externally through the core 10*a*.

Further, since the core 10*a* is round in section, the force that causes the chip 20 and the anvil 21 to approach each other is concentrated on the position where the ALS 2 is brought into contact with the flat harness 3. Therefore, the insulating layer 7 and cladding 11 which are molten are swiftly removed from between the conductive layer 4 and the core 10*a*. Thus, the conductive layer 4 and core 10*a* are surely bonded to each other. Accordingly, the noise which is about to invade the other cores 10*b* of the flat harness 3 can be surely dissipated outside the flat shield harness 1 through the single core 10*a*.

Embodiment 4

Referring to FIGS. 14 to 18, an explanation will be given of the fourth embodiment of this invention. As seen from these figures, a flat shield harness 1 includes a flat harness 3, an aluminum laminate sheet (ALS) 2 serving as a thin film sheet and a metallic piece 9. In these figures, like reference numerals refer to like elements in FIGS. 9 to 13 concerning the third embodiment.

The metallic piece 9 is a square plate having a uniform thickness. The shape and size of the metallic piece 9 can be optionally set. In the illustrate example, the metallic piece 9 has a longitudinal length that is much shorter than the entire length of the flat harness 3 and a width that is approximately equal to the diameter of the core 10.

The flat shield harness 1 is structured so that the ALS 2 with the conductive layer 4 located inside and the insulating layer 7 located outside is wound around the outer periphery of the flat harness 3 and the metallic piece 9 is superposed on the outside of the ALS 2, i.e. insulating layer 7. The conductive layer 4 at a part 2*e* of the ALS 2 (FIGS. 14 and 15) is metallic-bonded to one (selected core 10*a*) of the plurality of cores and the metallic piece 9. This core is denoted by 10*a* and the other cores are denoted by 10*b*.

Specifically, the core 10*a* is electrically connected to the conductive layer 4. The conductive layer 4 located at a part 2*e* of the ALS 2 can be fixed to the core 10*a* and the metallic piece 9 by a known technique such as spot welding or ultrasonic welding. Thus, the flat shield harness 1 is completed.

In this embodiment, the conductive layer 4 located at a part 2*e* of the ALS 2 is bonded to the core 10*a* and the metallic piece 9 using an ultrasonic welding machine. Namely, the part 2*e* is a bonding position therebetween.

Figure 17:
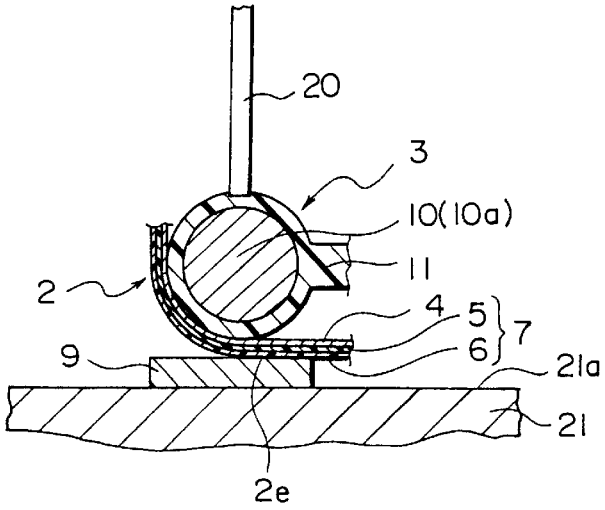
FIG. 17 is a sectional view of the state before the third core of an electric wire and the conductive layer of a conductive thin film sheet are bonded in the fourth embodiment.
Figure 18:
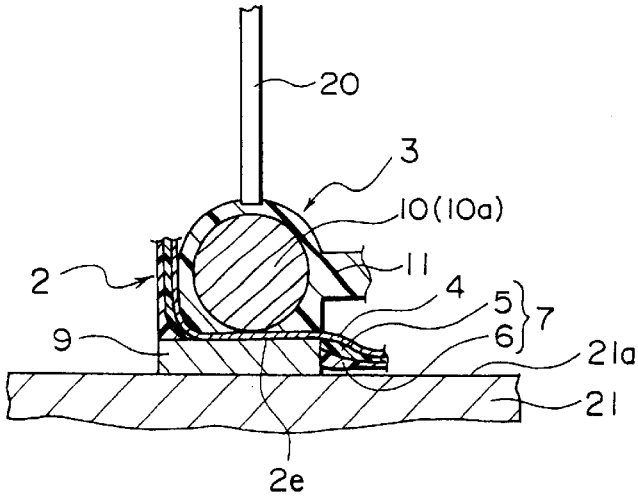
FIG. 18 is a sectional view of the state after the second core of an electric wire and the conductive layer of a conductive thin film sheet have been bonded to each other in the fourth embodiment.
Figure 16:
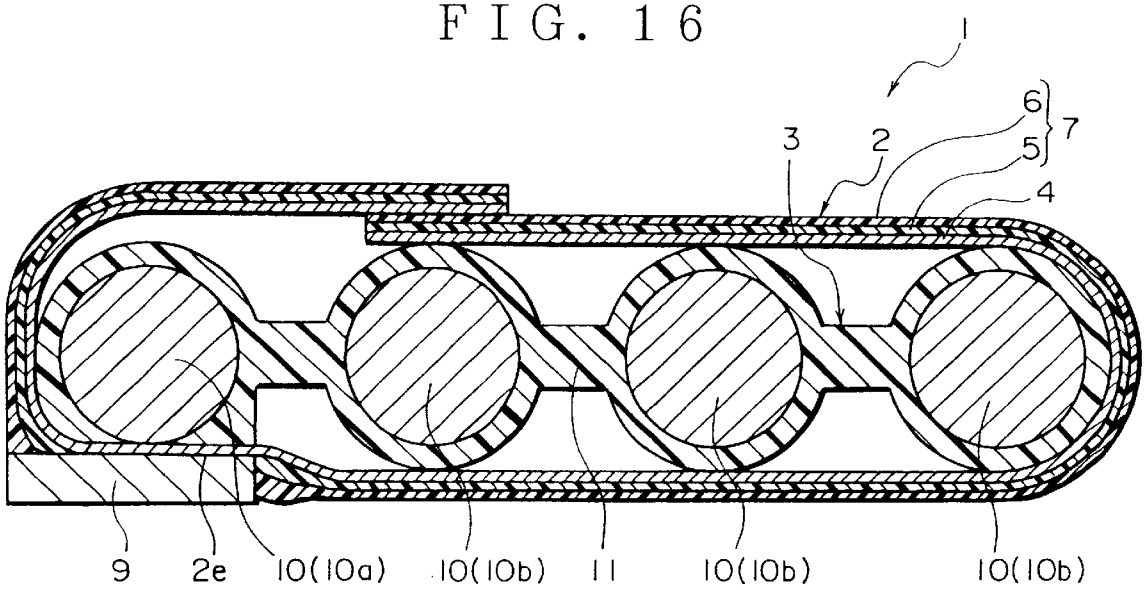
FIG. 16 is a sectional view taken along line XVI—XVI in FIG. 14.
Figure 20:
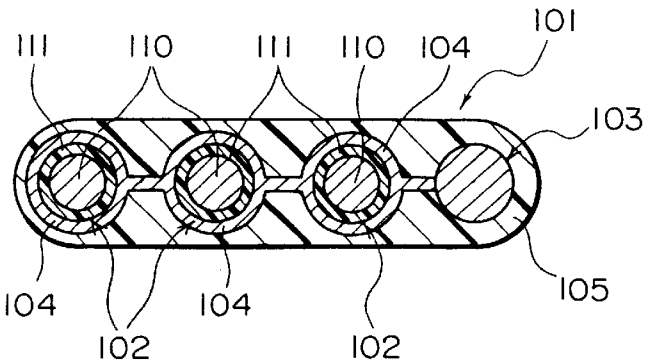
FIG. 20 is a sectional view taken along line X—X in FIG. 18.
Figure 19:
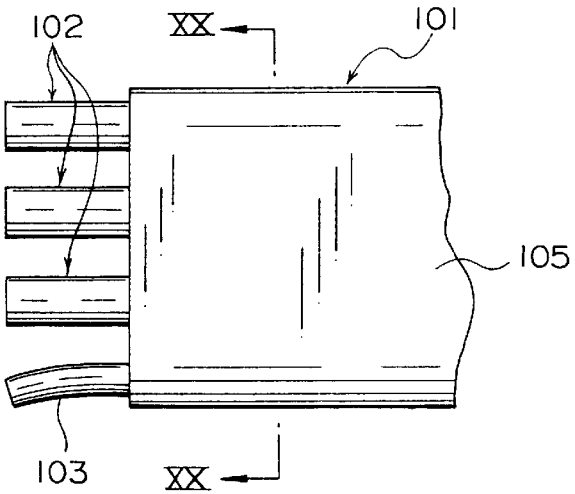
FIG. 19 is a plan view of a conventional flat harness.

As seen from FIGS. 17 and 18, the ultrasonic welding machine includes a chip (tool horn) 20, an anvil 21 corresponding to the chip 20, an oscillating machine (not shown), an oscillator, a cone (not shown), horn (not shown), etc. The chip 20 is formed in a shape of a band plate and the anvil 21 has a flat plane 21*a* on which an object for welding can be placed.

By the ultrasonic welding machine, the objects to be welded to each other are placed on the flat plane 21*a* and are sandwiched between the chip 20 and anvil 21. With the objects to weld sandwiched between the chip 20 and anvil 21 pressurized in a direction of causing them to approach each other, the ultrasonic welding machine oscillates the oscillator by the oscillating machine and gives the oscillation to the chip 20 via the cone and horn. Thus, the ultrasonic welding machine welds the objects to each other.

In manufacturing the flat shield harness 1, the metallic piece 9 is placed on the flat plane 21*a*, and the ALS 2 is further placed on the metallic piece 9 with the insulating layer 7 being contact with the metallic piece 9. With the single core 10*a* located on the metallic piece 9, the flat harness 3 is placed on the ALS 2. Namely, the single core 10*a* is superposed on the conductive layer 4.

As seen from FIG. 17, the chip 20 located on the single core 10*a* is brought into contact with the flat harness 3. Thus, the metallic piece 9, ALS 2 and single core 10*a* of the flat harness 3 are sandwiched between the chip 20 and anvil 21.

The chip 20 and anvil 21 are pressurized in a direction of causing them to approach each other. Since the cladding 11 is made of synthetic resin, a portion of the cladding 11 with which the tip of the chip 20 is brought into contact sinks. With the chip 20 and anvil 21 being pressurized in the direction of causing them to approach each other, the oscillation of the oscillator is given to the chip 20 via the cone and horn. This state is continued for a while.

Since a portion of the cladding 11 with which the tip of the chip 20 is brought into contact has already sunk, the flat harness 3 as well as the chip 20 oscillates. Then, the oscillation is generated between the ALS 2 and flat harness 3 so that the insulating layer 7 and the cladding 11 are first molten.

Owing to pressurizing in the direction of causing the chip 20 and the anvil 21 to approach each other, melting of the insulating layer 7 and the second cladding 13 leads to removal of the insulating layer 7 from between the conductive layer 4 and the metallic piece 9. Thus, the conductive layer 4 and metallic piece 9 are brought into contact with each other. When the core 10*a* is metallic-bonded to the conductive layer 4, the conductive layer 4 as well as the chip 20 and the flat harness 3 oscillates. The oscillation is also generated between the conductive layer 4 and the metallic piece 9 so that the conductive layer 4 and the metallic piece 9 are metallic-bonded in a solid state while they are not molten.

Namely, as seen from FIG. 18, the conductive layer 4 is bonded to the single core 10*a* and metallic piece 9 are bonded to each other by the ultrasonic welding. Thereafter, the ALS 2 with the conductive layer 4 located inside and the insulating layer 7 located outside is wound around the outer periphery of the flat harness 3 so that the ends thereof overlap. The overlapping ends of the ALS 2 are fixed to each other via known adhesive, double-faced or single-faced tape (not shown). Thus, the flat shield harness 1 can be completed in which the conductive layer 4 is bonded to the single core 10*a* and the metallic piece 9.

This embodiment is basically the same as the third embodiment except for the structure described above. Therefore, the effect obtained by the third embodiment can be also obtained in this embodiment.

In addition, in accordance with this embodiment, the core 10*a* is also bonded to the metallic piece 9 through the conductive layer 4. For this reason, the mechanical strength of the bonding portion 2*e* between the single core 10*a* and conductive layer 4 can be further improved. This assures an electric connection therebetween. Accordingly, the noise which is about to invade the other cores 10*b* of the flat harness 3 can be surely dissipated outside the flat shield harness 1 through the core 10*a*.

Where the ultrasonic welding is done, the metallic piece 9 is placed on the flat plane 21*a*. This prevents the metallic piece 9 from being deformed after the ultrasonic welding has been done. For this reason, the mechanical strength of the bonding portion 2*e* between the single core 10*a* and conductive layer 4 can be further improved, and an electric connection therebetween can be made more surely. Accordingly, the noise which is about to invade the other cores 10*b* of the flat harness 3 can be more surely dissipated outside the flat shield harness 1 through the single core 10*a*.

In the first to fourth embodiments, as the thin film sheet, the ALS 2 having the conductive layer 4 made of aluminum or aluminum alloy was adopted. However, as a matter of course, the thin film sheet having a conductive layer of the other metal than aluminum or aluminum alloy, e.g. copper or copper alloy may be adopted.

Further, in the first to fourth embodiments, the flat harness 3 in which a plurality of cores 10 round in section are arranged in parallel was adopted. However, as a matter of course, as the flat harness, a "flatcable" such as a flexible flat cable (FFC) or a flexible printed circuit (FPC) may be adopted in which conductors square in section are arranged in parallel.

Further, in the first to forth embodiments, the second core 12 of the electric wire 8 (core 10*a* in the third and fourth embodiments) was a twisted wire. However, in this invention, the second core 12 (core 10*a*) may be a single conductor wire or a solid wire. In this case, since the second core 12 (core 10*a*) is the single wire, the mechanical strength fixing the second core 12 (single core 10*a*) and conductor at the part 2*c* (part 2*d*, 2*e*) can be further improved. This permits the noise to be dissipated more surely through the electric wire 8 (single core 1*a*). Incidentally, as a matter of course, the cores 10 of the flat harness 3 may be a single wire, respectively.

In the first to fourth embodiments, the bonding position between the second core 12 (core 10*a*) and the conductive layer 4 was set a single point. However, a plurality of bonding points may be set in order to improve the mechanical strength fixing the second core 12 (core 10*a*) and the conductive layer 4.

What is claimed is:

1. A flat shield harness comprising:

a flat harness including a plurality of first conductive cores arranged in parallel and a first insulating cladding which clads the first conductive cores;

a thin film sheet having a thin film conductive layer; and an electric wire including a second conductive core and a second insulating cladding which clads said second core, wherein said thin film sheet is wound around the outer periphery of said flat harness with its ends superposed in a width direction of said flat harness, said electric wire is superposed on said ends, and the conductive layer at the ends of said thin film sheet at the ends is bonded to said second conductive core.

2. A flat shield harness according to claim 1, wherein said thin film sheet has a thin insulating layer laminated to said thin conductive layer, and the insulating layer of said thin film sheet at the ends and said second cladding of said electric wire are welded to each other.

3. A method for manufacturing a flat shield harness set forth in claim 2, comprising the steps of:

winding said thin film sheet around the outer periphery of said flat harness so that said conductive layer is located inside and said insulating layer is located outside and ends of said thin film sheet are superposed on each other;

superposing said electric wire on said ends of the conductor thin film; and bonding said second core of the electric wire to the conductive layer of said thin film sheet by ultrasonic welding.

4. A flat shield harness according to claim 1, further comprising a metallic plate interposed between and fixed to said ends of the thin film sheet, and said second core is metallic-bonded to the conductive layer and said metallic plate.

5. A method for manufacturing a flat shield harness set forth in claim 4, comprising the steps of:

winding said thin film sheet around the outer periphery of said flat harness so that said conductive layer is located inside and said insulating layer is located outside and ends of said thin film sheet are superposed on each other;

superposing said electric wire on said ends of the conductor thin film with a metallic plate being interposed between said ends; and bonding said second core of the electric wire to the conductive layer of said thin film sheet and said metallic plate by ultrasonic welding.

6. A flat shield harness according to claim 1, wherein said thin film sheet is divided into a plurality of sub-sheets, ends of said sub-sheets are superposed on each other in a width direction of said flat harness, and said electric wire is superposed on one of said ends of said sub-sheets.

7. A method for manufacturing a flat shield harness, including a flat harness including a plurality of conductive cores arranged in parallel and an insulating cladding which clads the conductive cores;

a thin film sheet having a thin film conductive layer; and a conductive metallic piece, wherein said thin film sheet is wound around the outer periphery of said flat harness, said metallic piece is superposed on the outside of said conductive thin film sheet, and said metallic piece is bonded to the thin conductive layer of the thin film sheet and a selected core of said cores of said flat harness, said method comprising the steps of:

winding said thin film sheet around the outer periphery of said flat harness so that said conductive layer is located inside and said insulating layer is located outside;

superposing said insulating layer of the thin film sheet on said metallic piece so that said selected core of said cores is located on said conductive layer of said thin film sheet; and bonding said conductive layer to said metallic piece and said selected core by ultrasonic welding, wherein said ultrasonic welding is performed using a chip in a shape of a band-plate and an anvil having a flat plane, and with the metallic piece superposed on said flat plane and flat harness in contact with said chip, said conductive layer is bonded to said metallic piece and said one core by the ultrasonic welding.

* * * * *